US011131129B2

(12) United States Patent
Westgarth et al.

(10) Patent No.: US 11,131,129 B2
(45) Date of Patent: Sep. 28, 2021

(54) MOTOR VEHICLE HAVING DOOR CHECK MECHANISM

(71) Applicant: Ford Global Technologies, LLC, Dearborn, MI (US)

(72) Inventors: Brian Westgarth, Billericay (GB); Jack Whitehurst, Leigh on Sea (GB); Rob Swann, Rayleigh (GB); Ian Patterson, Billericay (GB)

(73) Assignee: Ford Global Technologies, LLC, Dearborn, MI (US)

( * ) Notice: Subject to any disclaimer, the term of this patent is extended or adjusted under 35 U.S.C. 154(b) by 210 days.

(21) Appl. No.: 16/595,547

(22) Filed: Oct. 8, 2019

(65) Prior Publication Data

US 2020/0115938 A1 Apr. 16, 2020

(30) Foreign Application Priority Data

Oct. 10, 2018 (GB) ..... 1816534

(51) Int. Cl.
*E05C 17/18* (2006.01)
*E05C 17/20* (2006.01)

(52) U.S. Cl.
CPC ..... *E05C 17/18* (2013.01); *E05C 17/203* (2013.01); *E05Y 2900/531* (2013.01)

(58) Field of Classification Search
CPC ..... E05C 17/203; E05C 17/18; E05C 17/206; Y10T 16/61; E05Y 2900/531
See application file for complete search history.

(56) References Cited

U.S. PATENT DOCUMENTS 1,028,850 A * 6/1912 Aspegrén ..... E05C 17/203 16/82
1,483,912 A * 2/1924 Rissman ..... E05C 17/203 16/82
1,852,905 A * 4/1932 Emory ..... E05C 17/203 16/82
2,715,746 A * 8/1955 Travis ..... E05C 17/203 16/85
5,173,991 A * 12/1992 Carswell ..... E05C 17/20 16/86 A
5,474,344 A * 12/1995 Lee ..... E05C 17/203 16/86 C
5,727,287 A * 3/1998 Hosken ..... E05C 17/203 16/334
5,862,570 A * 1/1999 Lezuch ..... E05C 17/085 16/82
6,728,993 B1 * 5/2004 Murayama ..... E05C 17/206 16/342

(Continued)

FOREIGN PATENT DOCUMENTS

FR 2226858 A7 11/1974

*Primary Examiner* — Justin B Rephann
(74) *Attorney, Agent, or Firm* — David Coppiellie; Carlson, Gaskey & Olds, P.C.

(57) ABSTRACT

This disclosure relates to a motor vehicle having a door check mechanism. An example motor vehicle a pivotable door, a door check mechanism including a bar, wherein the door check mechanism is configured to hold the door open in a fully open check position, and a retarder assembly configured to oppose opening of the door beyond the fully open check position by applying a force generated by a non-linear surface of the bar.

8 Claims, 6 Drawing Sheets

(56) References Cited

U.S. PATENT DOCUMENTS

| | | | | |
|---|---|---|---|---|
| 7,076,833 | B2 * | 7/2006 | Murayama | E05C 17/203 16/82 |
| 7,240,399 | B2 * | 7/2007 | Murayama | E05C 17/203 16/82 |
| 7,640,627 | B2 * | 1/2010 | Lowen | E05C 17/203 16/86 C |
| 2002/0148074 | A1 * | 10/2002 | Audisio | E05B 77/42 16/344 |
| 2003/0051312 | A1 * | 3/2003 | Hoffmann | E05C 17/203 16/50 |
| 2003/0101537 | A1 * | 6/2003 | Matsuki | E05C 17/206 16/85 |
| 2003/0163895 | A1 * | 9/2003 | Liang | E05C 17/203 16/82 |
| 2004/0088823 | A1 * | 5/2004 | Moriyama | E05C 17/206 16/74 |
| 2009/0106934 | A1 * | 4/2009 | Chang | E05F 5/025 16/84 |
| 2009/0217592 | A1 * | 9/2009 | Tashima | E05C 17/206 49/148 |
| 2014/0041154 | A1 * | 2/2014 | Kamata | E05C 17/203 16/82 |
| 2015/0354259 | A1 * | 12/2015 | Broadhead | E05F 5/06 16/82 |
| 2019/0106917 | A1 * | 4/2019 | Patterson | E05C 17/206 |

* cited by examiner

MOTOR VEHICLE HAVING DOOR CHECK MECHANISM

RELATED APPLICATION(S)

This application claims priority to GB Patent Application No. GB 1816534.0, filed on Oct. 10, 2018, the entirety of which is herein incorporated by reference.

TECHNICAL FIELD

This disclosure relates to a motor vehicle having a door check mechanism.

BACKGROUND

Motor vehicle doors are known to include door check mechanisms having a linear door check bar for limiting the opening motion of a vehicle door that provides a number of intermediate stay positions.

SUMMARY

A motor vehicle according to an exemplary aspect of the present disclosure includes, among other things, a pivotable door, a door check mechanism including a bar, wherein the door check mechanism is configured to hold the door open in a fully open check position, and a retarder assembly configured to oppose opening of the door beyond the fully open check position by applying a force generated by a non-linear surface of the bar.

In a further non-limiting embodiment of the foregoing motor vehicle, the door check mechanism includes at least one detent configured to contact a recess in the bar to hold the door in the fully open check position.

In a further non-limiting embodiment of any of the foregoing motor vehicles, the detent is biased toward the recess by a spring.

In a further non-limiting embodiment of any of the foregoing motor vehicles, the bar is attached at a first end to a body of the motor vehicle and is attached to the door via a support housing.

In a further non-limiting embodiment of any of the foregoing motor vehicles, the support housing abuts a compressible member, and the reaction force is produced by deformation of the compressible member.

In a further non-limiting embodiment of any of the foregoing motor vehicles, the bar extends through an aperture in the compressible member.

In a further non-limiting embodiment of any of the foregoing motor vehicles, the non-linear surface is a curved portion of the bar or a non-linear section of a groove of the bar.

In a further non-limiting embodiment of any of the foregoing motor vehicles, the vehicle includes a pin engaging a groove in the bar, and the groove includes a linear section parallel with a longitudinal axis of the bar and a non-linear section.

In a further non-limiting embodiment of any of the foregoing motor vehicles, the pin is embedded in the compressible member.

In a further non-limiting embodiment of any of the foregoing motor vehicles, when the pin engages the non-linear section, the compressible member is torsionally deformed.

In a further non-limiting embodiment of any of the foregoing motor vehicles, the non-linear portion diverges from the longitudinal axis of the bar.

In a further non-limiting embodiment of any of the foregoing motor vehicles, the non-linear portion is helical.

In a further non-limiting embodiment of any of the foregoing motor vehicles, the bar includes a linear portion that produces substantially no deformation of the compressible member, and a non-linear portion that produces deformation of the compressible member.

In a further non-limiting embodiment of any of the foregoing motor vehicles, the non-linear portion is a curved portion of the bar.

DETAILED DESCRIPTION

Figure 1:
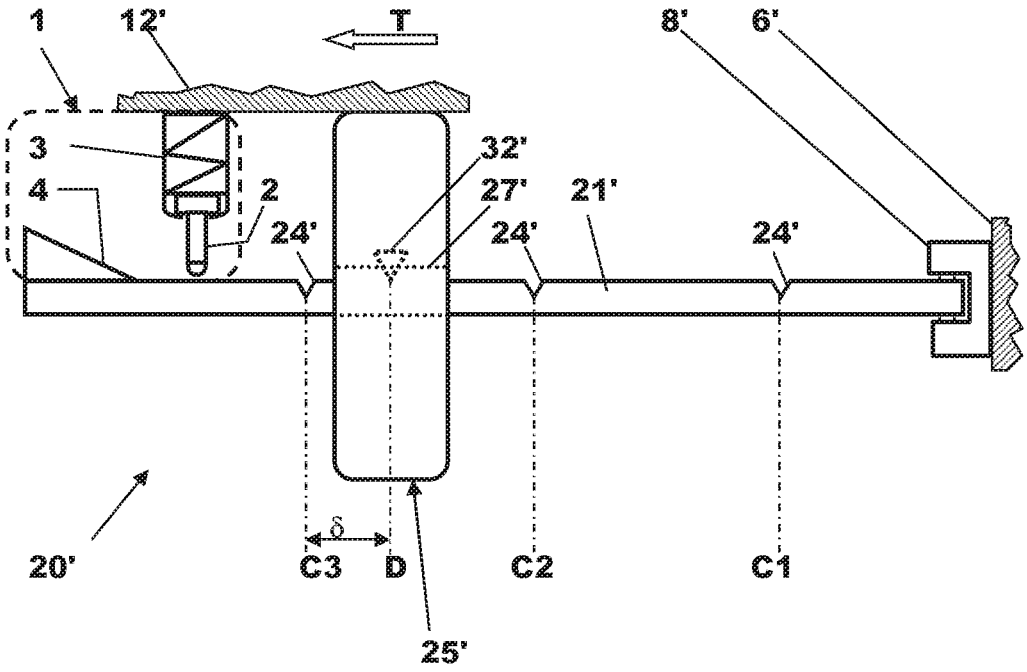
FIG. 1 is a schematic diagram of a door check mechanism according to this disclosure.

This disclosure relates to a motor vehicle having a door check mechanism. An example motor vehicle a pivotable door, a door check mechanism including a bar, wherein the door check mechanism is configured to hold the door open in a fully open check position, and a retarder assembly configured to oppose opening of the door beyond the fully open check position by applying a force generated by a non-linear surface of the bar. The retarder assembly prevents interference with other structures that by limiting possible overruns or overtravel of the door. These and other benefits will be appreciated from the following description.

The terms used in the claims, such as "door check mechanism," "compressible member," etc., are not generic placeholders for means or nonce terms, but are instead known terms in this art referring to a structure and/or structures with known meanings.

According to a first aspect of this disclosure there is provided a door check mechanism for a vehicle having a door pivotally mounted to part of a body structure of the vehicle for movement between open and closed positions, the door check mechanism comprising an elongate door check bar connected in use at a first end to one of part of the body structure of the vehicle and a structural part of the door, a support housing fastened to the other of the part of the body structure of the vehicle and the structural part of the door of the vehicle and a door holding mechanism through which the door check bar extends, the door holding mechanism having at least one spring loaded detent for engagement in use with one of a number of door check recesses formed at spaced apart position along the elongate door check bar corresponding to desired door check positions including a door fully open check position wherein the door check mechanism further comprises a door overrun retarder mechanism to apply a retarding force opposing opening of the door at least when the door fully open check position has been overrun.

The door check bar may be attached in use at the first end to part of the body structure of the vehicle and the support housing may be fastened in use to the structural part of the door of the vehicle.

The retarding force may comprise a combination of a reaction force opposing opening of the door produced when the door is opened past the door fully open check position and a friction force.

The door overrun retarder mechanism may comprise a compressible member and a driveable connection between the elongate door check bar to produce deformation of the compressible member when the door is opened past the door fully open check position.

The deformation of the compressible member may produce the reaction force opposing opening of the door.

The compressible member may be fastened to the support housing and may have an aperture through which the elongate door check bar extends and the driveable connection may comprise a groove extending along the elongate door check bar and a pin driveably connected to the compressible member engaged with the groove and the groove may have a linear portion arranged parallel to a longitudinal axis of the elongate door check bar that produces substantially no deformation of the compressible member when the door is moved and a non-linear portion diverging from the longitudinal axis of the elongate door check bar that deforms the compressible member when the fully open check position has been overrun.

The non-linear portion may be a curved portion of the groove.

Alternatively, the compressible member may be fastened to the support housing and may have an aperture through which the elongate door check bar extends, and the driveable connection may comprise a slot extending along the elongate door check bar and a pin driveably connected to the compressible member engaged with the slot and the slot may have a linear portion arranged parallel to a longitudinal axis of the elongate door check bar that produces substantially no deformation of the compressible member when the door is moved and a non-linear portion diverging from the longitudinal axis of the elongate door check bar that deforms the compressible member when the fully open check position has been overrun.

The non-linear portion may be a curved portion of the slot.

As yet another alternative, the compressible member may be fastened to the support housing and the driveable connection may comprise a tubular member fastened in an aperture in the compressible member having a bore through which the elongate door check bar extends and the elongate door check bar may have a linear portion that produces substantially no deformation of the compressible member when the door is moved and a non-linear portion that interacts with the bore in the tubular member to deform the compressible member when the fully open check position has been overrun.

The non-linear portion may be a curved portion of the elongate door check bar.

As yet a further alternative, the compressible member may be fastened to the support housing and may have an aperture through which the elongate door check bar extends and the driveable connection may comprise a groove extending along the elongate door check bar and a pin driveably connected to the compressible member engaged with the groove. The groove may have a linear portion arranged parallel to a longitudinal axis of the elongate door check bar that produces substantially no deformation of the compressible member when the door is moved and a helical portion that deforms the compressible member when the fully open check position has been overrun.

Each pin may be driveably connected to the compressible member by being embedded therein.

According to a second aspect of this disclosure there is provided a vehicle having a door hingedly mounted on part of a body structure of the vehicle for movement between open and closed positions wherein the vehicle has at least one door check mechanism constructed in accordance with said first aspect of this disclosure.

It will be appreciated that the figures are provided for illustrative purposes only and are not intended to represent fully engineered components.

With reference to FIG. 1 there is shown schematically a door check mechanism constructed in accordance with this disclosure.

The door check mechanism 20' comprises a door check bar 21' adapted at one end for attachment to part of a body structure 6' of a vehicle by means of a transverse aperture formed in the door check bar 21' accommodating a mounting pin. The mounting pin is engaged with a bracket 8' fastened to part of the body structure 6' of the vehicle.

A support housing 25' mounted on a structural part 12' of a door has a passage 27' through which the door check bar 21' extends.

The door check bar 21' is, in the case of this example, rectangular in cross-section and has three spaced apart recesses 24' for co-operation with a door holding mechanism disposed within the support housing 25' so as to provide check positions C1, C2, C3 for a door to which the support housing 25' is fastened via the structural part 12' of the door. The door check position C3 corresponds to a door fully open position and the positions C1 and C2 correspond to intermediate door open check positions.

The door fully open position C3 is an opening position of the door that will not cause any interference with the door or to any other components. The door can open further than the door fully open check position C3 in what is termed 'overrun' motion or 'over-travel' motion but this may lead to interference with the door or to other associated components.

The door holding mechanism comprises a detent 32' biased by a respective spring (not shown) towards the door check bar 21' so as to engage with the one of the recesses 24' in the door check bar 21' when the door is at one of the predefined check positions C1, C2, C3. The door check mechanism 20' further comprises a door overrun retarder mechanism 1 to apply a retarding force opposing opening of the door at least when the door fully open check position C3 has been overrun.

The door overrun retarder mechanism 1 comprises a compressible member in the form of a caged helical spring 3 and a driveable connection between the door check bar 21' and the caged spring 3 in the form of an actuating pin 2 and an inclined surface 4. The actuating pin 2 and the inclined surface 4 act in combination produce deformation of the caged spring 3 when the door is opened past the door fully open check position C3. When the door is open less than that of the fully open check position C3 there is no contact between the actuating pin 2 and the door check bar 21' or with the inclined surface 4 and so the door is able to move freely within this range of movement.

When the door reaches the fully open check position C3 the detent 32' will have been displaced a distance 'δ' in the door opening direction T from its current position D allowing it to engage with the recess 24' corresponding to door fully open check position C3. This causes the actuating pin 2 into contact with the inclined surface 4.

If the door continues to move in the opening direction T past the fully open check position C3 into an overrun position then the actuating pin 2 will ride up the inclined surface 4 thereby compressing the caged spring 3.

The interaction between the actuating pin 2 and the inclined surface 4 has two effects, firstly a reaction force from the caged spring 3 acts as a force resisting further motion of the door in the door opening direction T and, secondly, the interaction between the actuating pin 2 and the inclined surface 4 produces a friction force slowing movement of the door in the door opening direction T.

Therefore, in a case where the fully open check position C3 is overrun, a retarding force is automatically produced by the door overrun retarder mechanism 1 that comprises a combination of the reaction force opposing opening of the door produced by the caged spring 3 and the friction force produced by the interaction of the actuating pin 2 with the inclined surface 4. The effect of this retarding force is to slow opening motion of the door thereby reducing its kinetic energy and reducing the likelihood of damage occurring to either the door or other associated components or parts.

Figure 2:
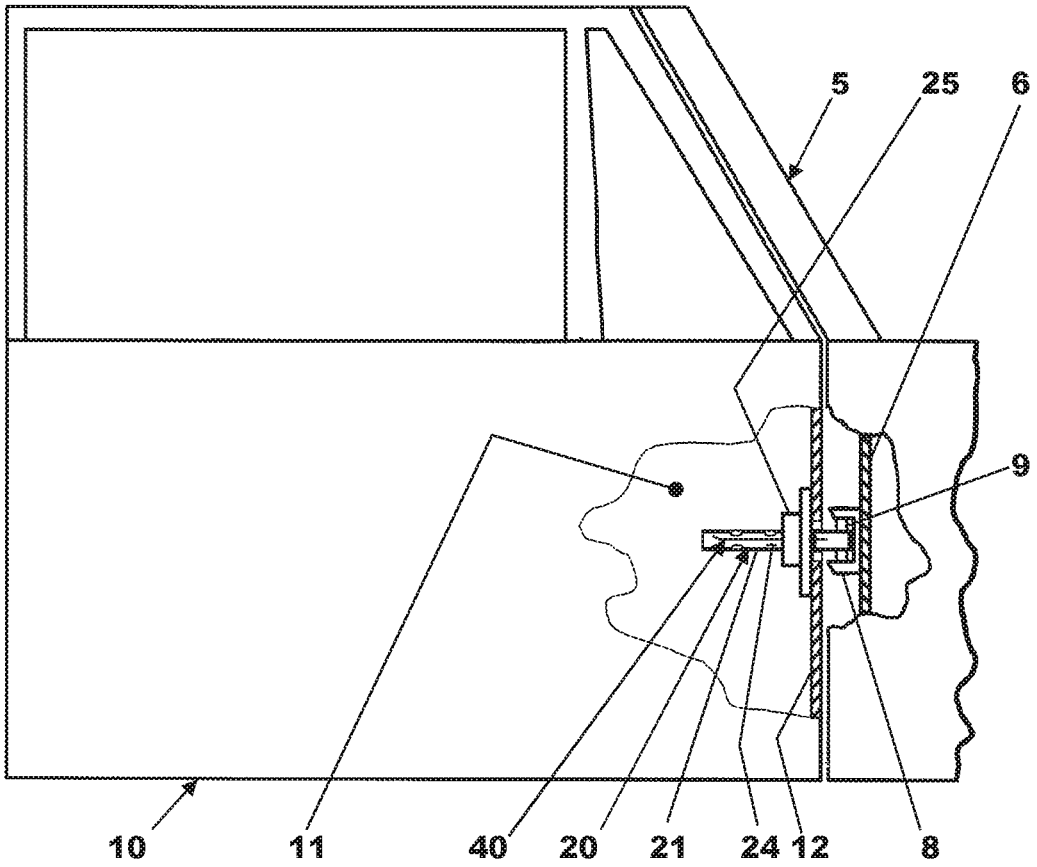
FIG. 2 is a partially cutaway side view of a vehicle having a door check mechanism in accordance with a first embodiment of this disclosure showing a door of the vehicle in a closed position.
Figure 3:
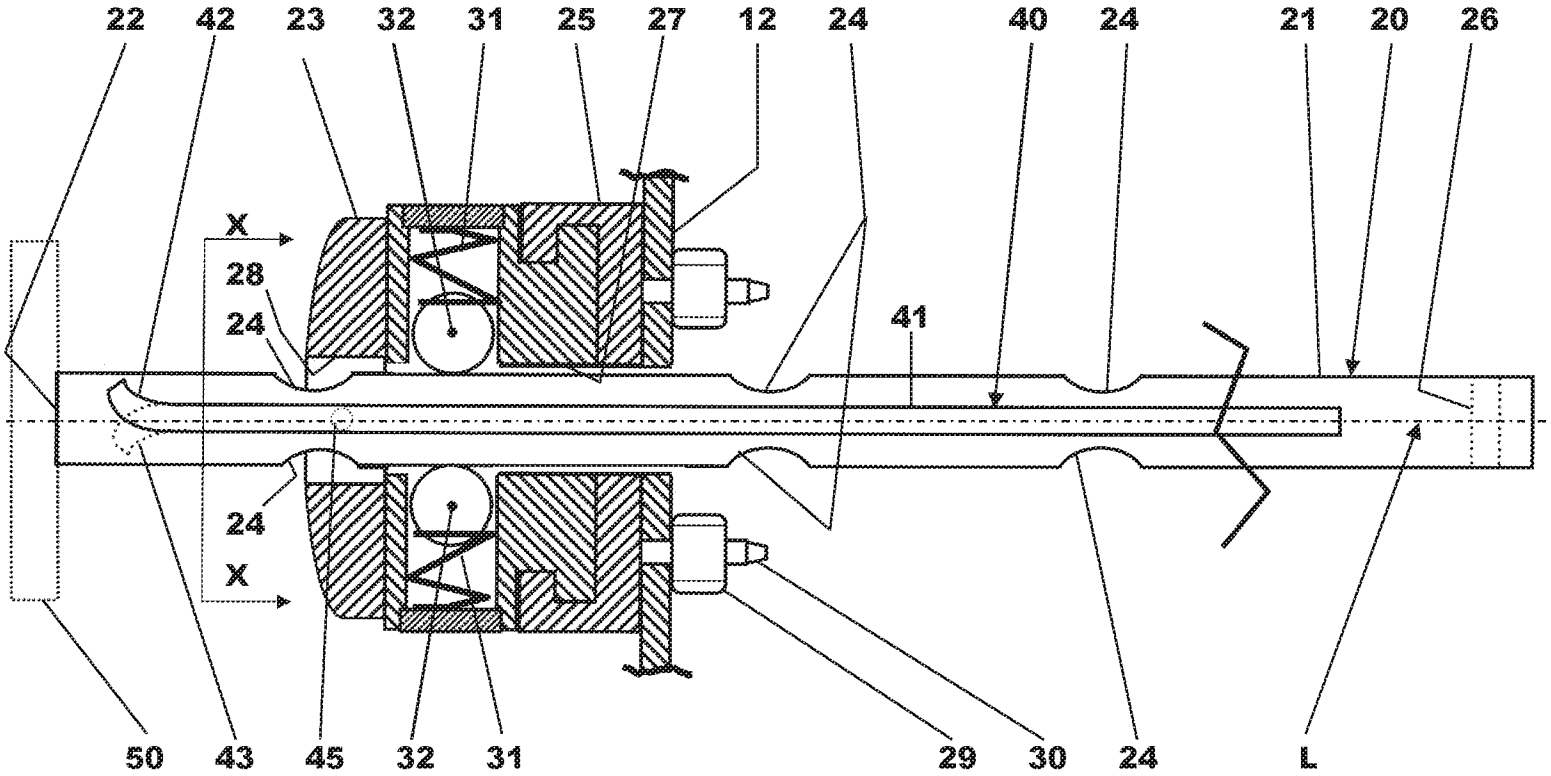
FIG. 3 is an enlarged partially cross-sectioned view of the door check mechanism shown in FIG. 2 showing the door check mechanism when the door is approaching a fully open check position.
Figure 4:
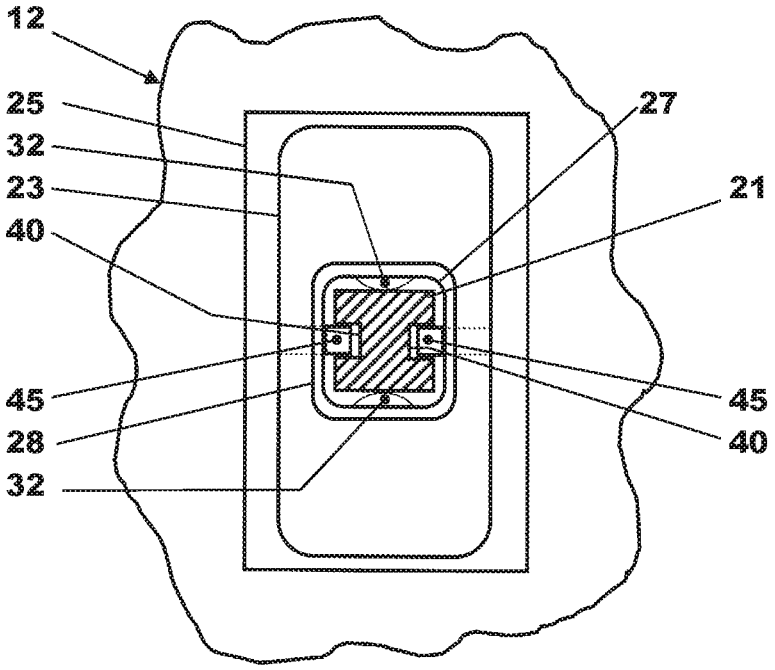
FIG. 4 is a view on the line X-X on FIG. 3.

With reference to FIGS. 2 to 4 there is shown a first embodiment of a door check mechanism fitted to a vehicle 5.

The vehicle 5 has a door 10 pivotally mounted by a pair of hinges (not shown) to part of a body structure 6 of the vehicle 5 for movement between fully open and fully closed positions and a door check mechanism 20 to control movement of the door 10.

The door 10 has a door structure defining a cavity 11 in which a support housing 25 of the door check mechanism 20 is mounted to a structural part 12 of the door 10 defining a front end of the door cavity 11.

The door check mechanism 20 includes an elongate door check bar 21 adapted at one end for attachment to part of the body structure 6 of the vehicle 5 by means of a transverse aperture 26 formed in the elongate door check bar 21 for accommodating a mounting pin 9. The mounting pin 9 is engaged with a bracket 8 fastened to part of the body structure 6 of the vehicle 5.

The support housing 25 of the door check mechanism 20 has a passage 27 through which the elongate door check bar 21 extends. The support housing 25 is secured to the door structure 12 via a number of nuts 29 and threaded studs 30. The studs 30 being welded to an end face of the support housing 25.

The elongate door check bar 21 is, in the case of this example, rectangular in cross-section and has three spaced apart recesses 24 on upper and lower faces for co-operation with a door holding mechanism disposed in the support housing 25 so as to provide door check holding positions for the door 10 comprising a fully open check position and two intermediate check positions.

The door holding mechanism comprises a pair of locking members in the form of two balls 32 each being biased by a respective spring 31 towards the elongate door check bar 21 so as to engage with the one of the recesses 24 in the elongate door check bar 21 when the door 10 is in a predefined check position.

In accordance with this disclosure the door check mechanism 20 further comprises a door overrun retarder mechanism to apply a retarding force opposing opening of the door 10 at least when a door fully open check position has been overrun.

The door overrun retarder mechanism comprises a compressible member 23 in the form of a block of compressible material and a driveable connection between the compressible member 23 and the elongate door check bar 21 to produce deformation of the compressible member 23 when the door 10 is opened past the door fully open check position.

The compressible member 23 is fastened to the support housing 25 by in this case adhesive bonding and has an aperture 28 through which the elongate door check bar 21 extends with clearance.

The driveable connection comprises a groove 40 extending along each side of the elongate door check bar and a pair of pins 45 driveably connected to the compressible member 23 by in this case being embedded in the compressible member 23. Each of the pins 45 projects out from the compressible member 23 for engagement with clearance in a respective one of the grooves 40.

It will be appreciated that other means for producing a driveable connection could be used and that this disclosure is not limited to the use of embedded pins.

Each groove 40 has a linear portion 41 arranged parallel to a longitudinal axis L of the elongate door check bar 21 that produces substantially no deformation of the compressible member 23 when the door 10 is moved between a fully closed position and the door fully open check position. Each groove 40 also has a non-linear portion 42 diverging from the longitudinal axis L of the elongate door check bar 21 that deforms the compressible member 23 when the fully open check position has been overrun. In the case of this example the non-linear portion is in the form of a curved portion 42 of the groove 40.

As an alternative shown in dotted outline, a curved portion 43 of the groove 40 on a reverse side of the elongate door check bar 21 can be arrange to diverge in an opposite direction to the curved portion 42 on the side of the elongate door check bar 21 visible in FIG. 3 this will have the effect of deforming the compressible member 23 in torsion rather than shear.

As further alternatives there may only be a groove in one face of the elongate door check bar and a single pin or the pair of grooves can be replaced by a through slot engaged by a pin or pins.

In use, when the door 10 is opened by an amount less than that required to reach the fully open check position the pins 45 will move along the linear portions 41 of the grooves 40 with which they are freely engaged and will not cause any significant deformation of the compressible member 23 due to the clearance present between each pin 45 and the respective groove 40 with which it is engaged and the fact that the grooves 40 are arranged parallel to the longitudinal axis L of the elongate door check bar 21.

However, when the door 10 reaches the fully open check position the pins 45 are located in the grooves 40 at the juncture of the linear portions 41 and the non-linear portions 42 and any movement past this position will be resisted by applying a retarding force to the door 10.

It will be appreciated that if desired the position at which a retarding force is applied could be arranged to slightly precede the fully open check position such as may be the case if the door 10 is very heavy.

When the door 10 overruns the fully open check position the pins 45 are engaged with non-linear portions 42 of the grooves 40 and any movement is resisted by applying a retarding force to the door 10 comprised of a reaction force from the compressible member 23 that opposes further opening of the door 10 and a friction force due to interaction between the pins 45 and the non-linear portions 42 of the grooves 40.

It will be appreciated that as the door 10 is moved with the pins 45 engaged in the non-linear portions 42 the pins 45 are moved away from the longitudinal axis L of the elongate door check bar 21 thereby deforming the compressible member 23 in which they are embedded. This produces a reaction force acting on the pins 45 pressing the pins 45 against the non-linear portions 42 of the grooves 40 thereby generating friction between the pins 45 and the non-linear portions 42 of the grooves 40 and resisting motion of the door 10.

The retarding force produced by this combination of reaction force and friction will have the effect of slowing the door 10 as it moves in a door opening direction thereby reducing the kinetic energy of the door 10 and either eliminating or significantly reducing any damage that would otherwise occur due to such high speed overrun motion of the door 10.

In some embodiments the elongate door check arm 21 has an end stop 50 (shown as a dotted outline on FIG. 3) and the compressible member 23 is arranged to shear off the support housing 25 when a predefined force has be applied and will then act as a conventional bump stop.

Figure 6:
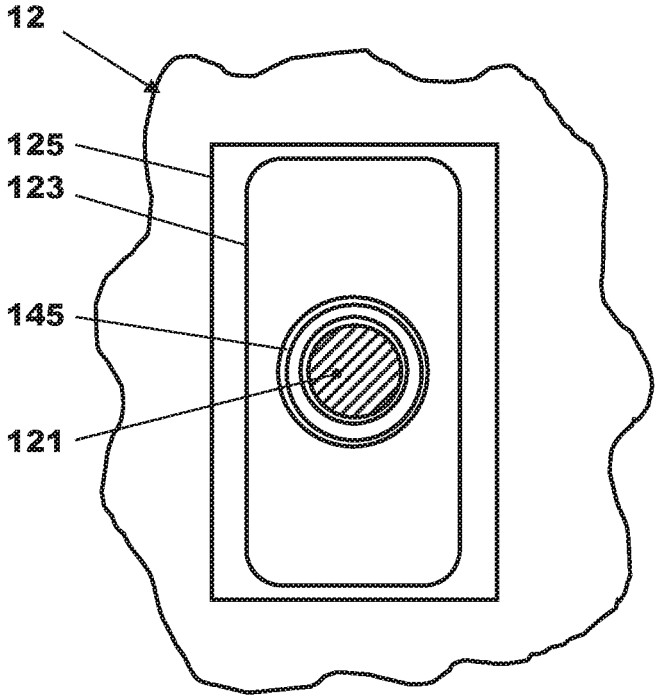
FIG. 6 is a view on the line Y-Y on FIG. 5.
Figure 5:
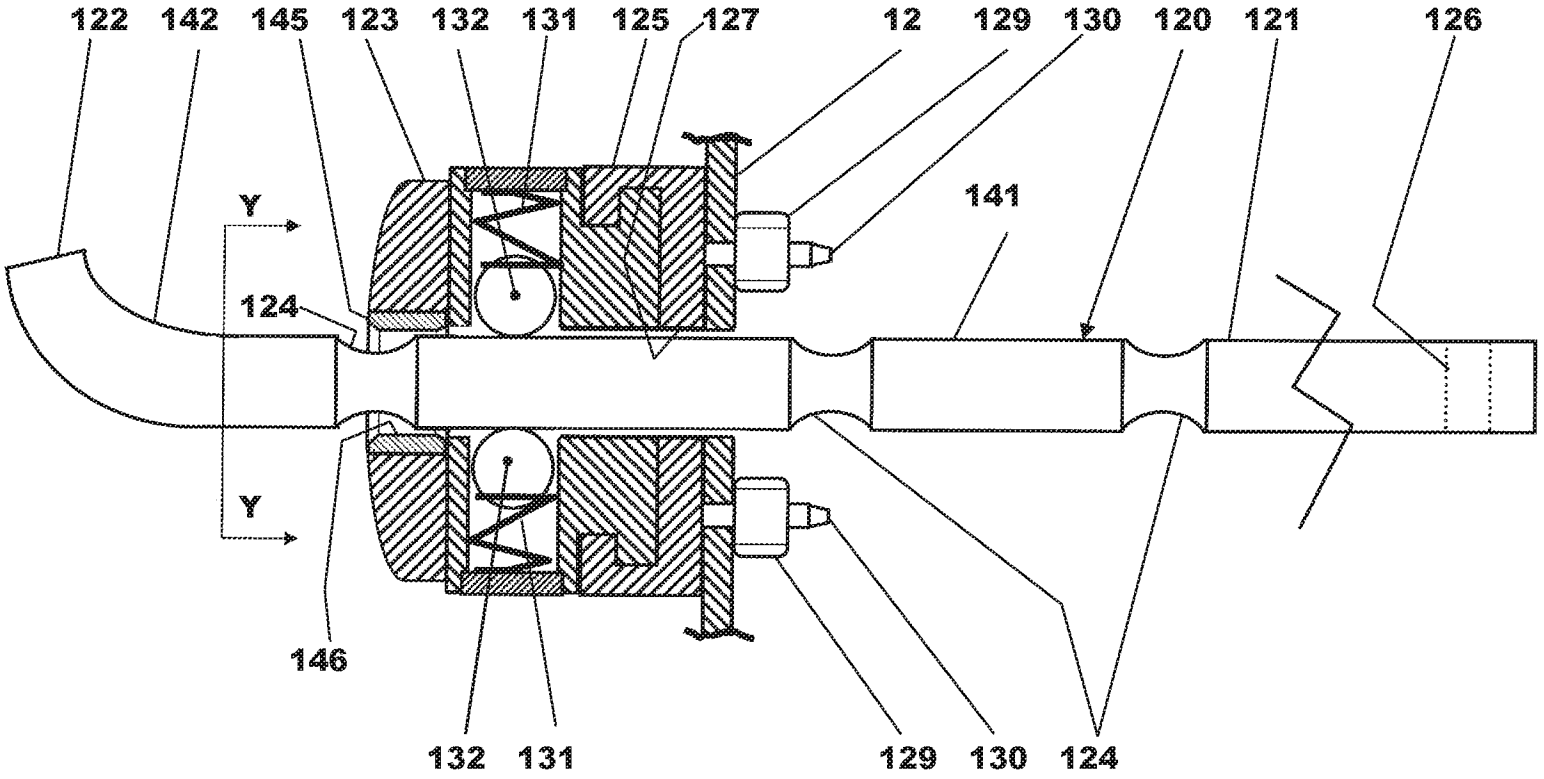
FIG. 5 is a view similar to FIG. 3 but showing a second embodiment of a door check mechanism in accordance with this disclosure.

With reference to FIGS. 5 and 6 there is shown a second embodiment of a door check mechanism for a vehicle such as the vehicle 5 that is intended to be a direct replacement for the door check mechanism previously described with respect to FIGS. 2 to 4.

As before, the vehicle 5 has a door 10 pivotally mounted by a pair of hinges (not shown) to part of a body structure 6 of the vehicle 5 for movement between fully open and fully closed positions and a door check mechanism 120 to control movement of the door 10. As before, the door 10 has a door structure defining a cavity 11 in which a support housing 125 of the door check mechanism 120 is mounted to a structural part 12 of the door 10 defining a front end of the door cavity 11.

In the case of this second embodiment the door check mechanism 120 includes an elongate door check bar 121 adapted at one end for attachment to part of the body structure 6 of the vehicle 5 by means of a transverse aperture 126 formed in the elongate door check bar 121 for accommodating a mounting pin engaged with a bracket fastened to part of the body structure 6 of the vehicle 5.

The support housing 125 of the door check mechanism 120 has a passage 127 through which the elongate door check bar 121 extends. The support housing 125 is secured to the door structure 12 via a number of nuts 129 and threaded studs 130. The studs 130 are welded to an end face of the support housing 125.

The elongate door check bar 121 is, in the case of this example, circular in cross-section and has three spaced apart recesses 124 for co-operation with a door holding mechanism disposed in the support housing 125 so as to provide door check holding positions for the door 10 comprising a fully open check position and two intermediate check positions.

The door holding mechanism comprises a pair of locking members in the form of two balls 132 each being biased by a respective spring 131 towards the elongate door check bar 121 so as to engage with the one of the recesses 124 in the elongate door check bar 121 when the door 10 is in a predefined check position.

In accordance with this disclosure the door check mechanism 120 further comprises a door overrun retarder mechanism to apply a retarding force opposing opening of the door 10 at least when a door fully open check position has been overrun.

The door overrun retarder mechanism comprises a compressible member 123 in the form of a block of compressible material and a driveable connection between the compressible member 123 and the elongate door check bar 121 to produce deformation of the compressible member 123 when the door 10 is opened past the door fully open check position.

The compressible member 123 is fastened to the support housing 125 by in this case adhesive bonding and has an aperture in which a tubular member 145 is fixed.

The tubular member 145 has a bore 146 through which the elongate door check bar 121 extends with clearance.

The driveable connection comprises the tubular member 145 and an outer surface of the elongate door check bar 121.

The elongate door check bar 121 has a linear portion 141 that produces substantially no deformation of the compressible member 123 when the door 10 is moved between a fully closed position and the door fully open check position. The elongate door check bar 121 also has a non-linear portion 142 that interacts with the bore 146 in the tubular member 145 to deform the compressible member 123 when the fully open check position has been overrun.

The non-linear portion is a curved portion 142 of the elongate door check bar 121.

In use, when the door 10 is opened by an amount less than that required to reach the fully open check position this will cause no significant deformation of the compressible member 123 due to clearance present between the elongate door check bar 121 and the bore 146 in the tubular member 145.

However, when the door 10 reaches the fully open check position the curved portion 142 will interact with the bore 146 in the tubular member 145 and any movement past this position will be resisted by applying a retarding force to the door 10.

It will be appreciated that if desired the position at which a retarding force is applied could be arranged to slightly precede the fully open check position if required.

When the door 10 overruns the fully open check position the outer surface of the elongate door check bar 121 is engaged with the bore 146 in the tubular member 145 and any door opening movement is resisted by applying a retarding force to the door 10 comprised of a reaction force from the compressible member 123 that opposes further opening of the door 10 and a friction force due to interaction between the bore 146 and the curved portion 142 of the elongate door check bar 121.

It will be appreciated that as the door 10 is moved with the elongate door check bar 121 engaging with the bore 146 the tubular member 145 is displaced laterally thereby deforming the compressible member 123 in which it is fixed.

This displacement of the tubular member 145 produces a reaction force acting on the tubular member 145 pressing it against the curved portion 142 of the elongate door check bar 121 thereby generating friction between the tubular member 145 and the curved portion 142 of the elongate door check bar 121.

The retarding force produced by this combination of reaction force and friction will have the effect of slowing the door 10 as it moves in a door opening direction thereby reducing the kinetic energy of the door 10 and either eliminating or significantly reducing any damage that would otherwise occur due to such high speed overrun motion of the door 10.

Figure 8:
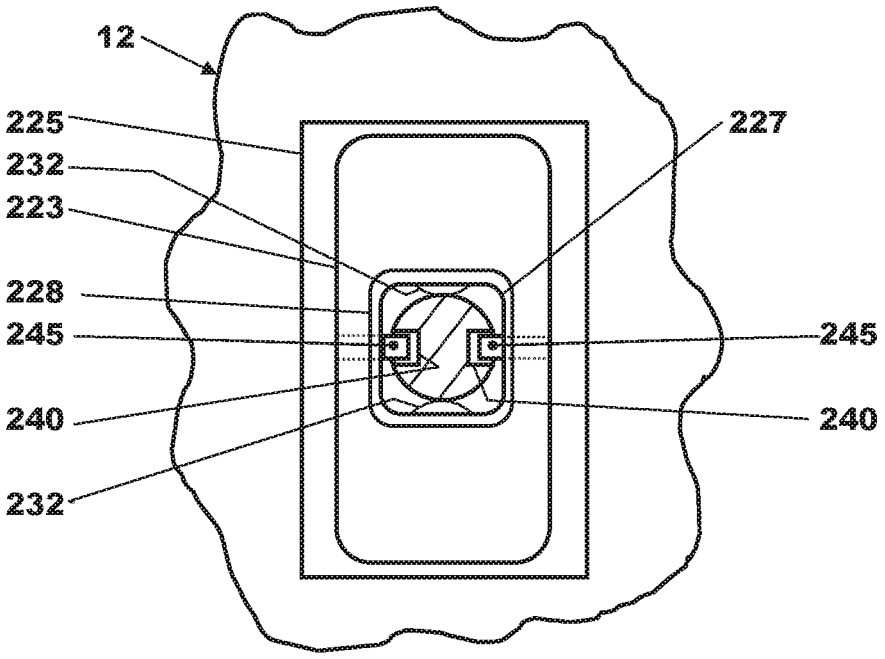
FIG. 8 is a view on the line Z-Z on FIG. 5.
Figure 7:
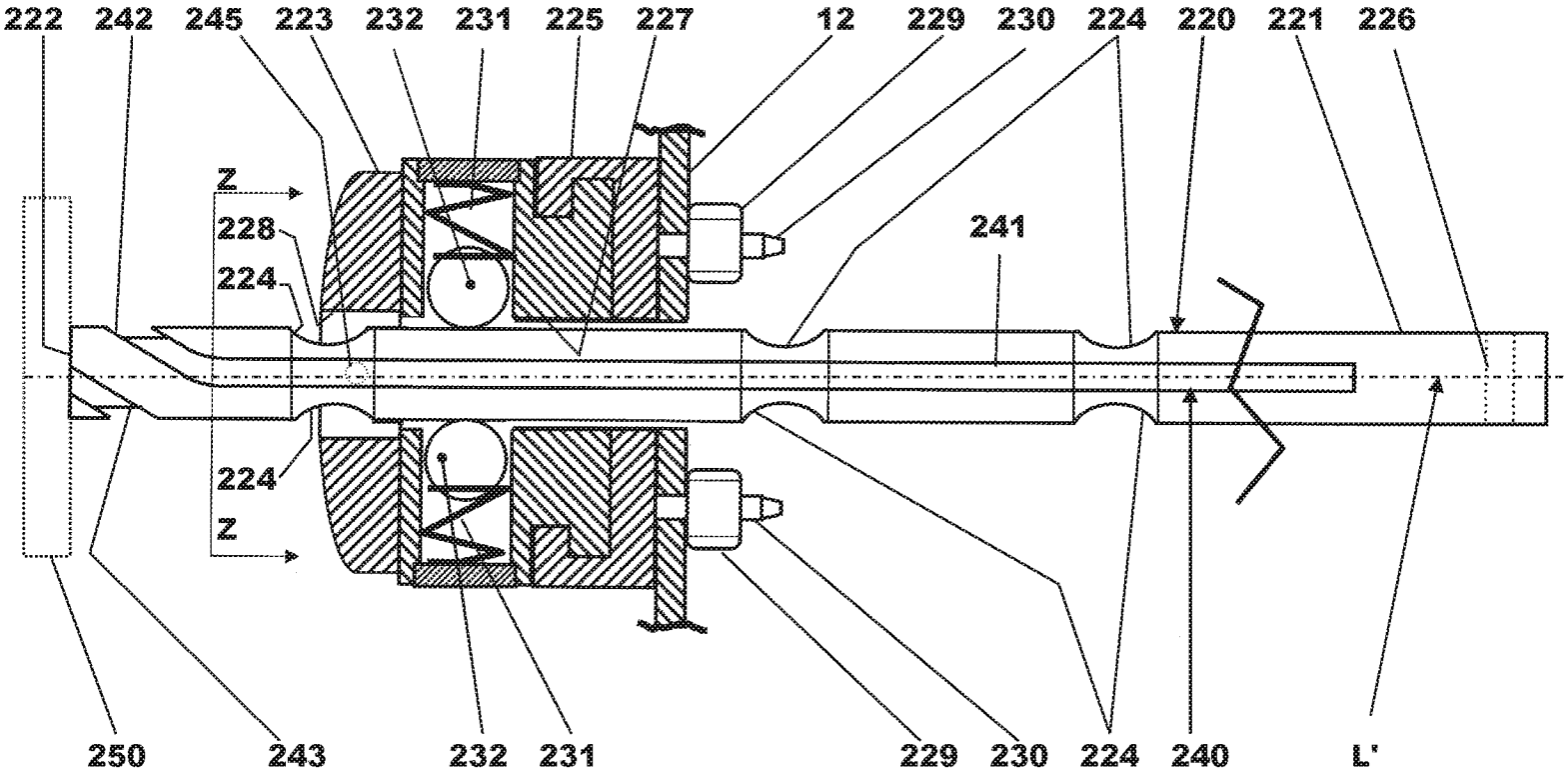
FIG. 7 is a view similar to FIG. 3 but showing a third embodiment of a door check mechanism in accordance with this disclosure.

With reference to FIGS. 7 and 8 there is shown a third embodiment of a door check mechanism for a vehicle such as the vehicle 5 that is intended to be a direct replacement for the door check mechanism previously described with respect to FIGS. 2 to 4.

As before, the vehicle 5 has a door 10 pivotally mounted by a pair of hinges (not shown) to part of a body structure 6 of the vehicle 5 for movement between fully open and fully closed positions and a door check mechanism 220 to control movement of the door 10. As before, the door 10 has a door structure defining a cavity 11 in which a support housing 225 of the door check mechanism 220 is mounted to a structural part 12 of the door 10 defining a front end of the door cavity 11.

The door check mechanism 220 includes an elongate door check bar 221 adapted at one end for attachment to part of the body structure 6 of the vehicle 5 by means of a transverse aperture 226 formed in the elongate door check bar 221 for accommodating a mounting pin. As before, the mounting pin is engaged with a bracket fastened to part of the body structure 6 of the vehicle 5.

The support housing 225 of the door check mechanism 220 has a passage 227 through which the elongate door check bar 221 extends. The support housing 225 is secured to the door structure 12 via a number of nuts 229 and threaded studs 230. The studs 230 are friction welded to an end face of the support housing 225.

The elongate door check bar 221 is, in the case of this example, circular in cross-section and has three spaced apart recesses 224 for co-operation with a door holding mechanism disposed in the support housing 225 so as to provide door check holding positions for the door 10 comprising a fully open check position and two intermediate check positions.

The door holding mechanism comprises a pair of locking members in the form of two balls 232 each being biased by a respective spring 231 towards the elongate door check bar 221 so as to engage with the one of the recesses 224 in the elongate door check bar 221 when the door 10 is in a predefined check position.

In accordance with this disclosure the door check mechanism 220 further comprises a door overrun retarder mechanism to apply a retarding force opposing opening of the door 10 at least when a door fully open check position has been overrun.

The door overrun retarder mechanism comprises a compressible member 223 in the form of a block of compressible material and a driveable connection between the compressible member 223 and the elongate door check bar 221 to produce deformation of the compressible member 223 when the door 10 is opened past the door fully open check position.

The compressible member 223 is fastened to the support housing 225 by in this case adhesive bonding and has an aperture 228 through which the elongate door check bar 221 extends with clearance.

The driveable connection comprises a pair of grooves 240 extending along the elongate door check bar and a pair of pins 245 driveably connected to the compressible member 223 by being embedded therein. Each of the pins 245 projects out from the compressible member 223 for engagement with clearance in a respective one of the grooves 240.

Each groove 240 has a linear portion 241 arranged parallel to a longitudinal axis L' of the elongate door check bar 221 that produces substantially no deformation of the compressible member 223 when the door 10 is moved between a fully closed position and the door fully open check position. Each groove 240 also has a respective non-linear portion 242,243 that deform the compressible member 223 when the fully open check position has been overrun.

In the case of this example the non-linear portions are in the form of helical grooves 242, 243 which have the effect of deforming the compressible member 223 in torsion when engaged by the pins 245.

As an alternative there may only be a single groove in the elongate door check bar 221 and a single pin 245.

In use, when the door 10 is opened by an amount less than that required to reach the fully open check position the pins 245 will move along the linear portions 241 of the grooves 240 with which they are freely engaged and will not cause any significant deformation of the compressible member 223 due to the clearance present between each pin 245 and the respective groove 240 with which it is engaged and the fact that the grooves 240 are arranged parallel to the longitudinal axis L' of the elongate door check bar 221.

However, when the door 10 reaches the fully open check position the pins 245 are located in the grooves 240 at the juncture of the linear portions 241 and the non-linear portions 242 and any movement past this position will be resisted by applying a retarding force to the door 10.

It will be appreciated that if desired the position at which a retarding force is applied could be arranged to slightly precede the fully open check position if required.

When the door 10 overruns the fully open check position the pins 245 are engaged with helical non-linear portions 242 of the grooves 240 and any movement is resisted by applying a retarding force to the door 10 comprised of a reaction force from the compressible member 223 that opposes further opening of the door 10 and a friction force due to interaction between the pins 245 and the non-linear portions 242 of the grooves 240.

It will be appreciated that as the door 10 is moved with the pins 245 engaged in the helical non-linear portions 242 the pins 245 are rotated about the longitudinal axis L' of the elongate door check bar 221 thereby torsionally deforming the compressible member 223 in to which they are fastened. This produces a reaction force from the compressible member 223 acting on the pins 245 thereby pressing the pins 245 against the helical non-linear portions 242 of the grooves 240 and generating friction between the pins 245 and the helical non-linear portions 242 of the grooves 240.

The retarding force produced by this combination of reaction force and friction will have the effect of slowing the door 10 as it moves in a door opening direction thereby reducing the kinetic energy of the door 10 and either eliminating or significantly reducing any damage that would otherwise occur due to such high speed overrun motion of the door 10.

It will be appreciated that the friction within the door check mechanism provided by the door overrun retarder mechanism will helps to dampen out rapid door movements and prevent damage from occurring. It will be further appreciated that the reaction force from the compressible member acts in an opposite direction to a force produced by the kinetic energy of the opening door thereby slowing the door.

In some embodiments the elongate door check arm 221 has an end stop 250 (shown as a dotted outline on FIG. 7) and the compressible member 223 is arranged to shear off the support housing 225 when a predefined force has be applied and will then act as a conventional bump stop.

It should be understood that terms such as "about," "substantially," and "generally" are not intended to be boundaryless terms, and should be interpreted consistent with the way one skilled in the art would interpret those terms. It should also be understood that directional terms such as "forward," "rear," "side," etc., are used herein relative to the normal operational attitude of a vehicle for purposes of explanation only, and should not be deemed limiting.

Although the different examples have the specific components shown in the illustrations, embodiments of this disclosure are not limited to those particular combinations. It is possible to use some of the components or features from one of the examples in combination with features or components from another one of the examples. In addition, the various figures accompanying this disclosure are not necessarily to scale, and some features may be exaggerated or minimized to show certain details of a particular component or arrangement.

One of ordinary skill in this art would understand that the above-described embodiments are exemplary and non-limiting. That is, modifications of this disclosure would come within the scope of the claims. Accordingly, the following claims should be studied to determine their true scope and content.

The invention claimed is:

1. A motor vehicle, comprising:

a pivotable door;

a door check mechanism including a bar, wherein the door check mechanism is configured to hold the door open in a fully open check position; and a retarder assembly configured to oppose opening of the door beyond the fully open check position by applying a retarding force to the door, wherein the retarding force is generated by interaction between the retarder assembly and a non-linear surface of the bar, wherein the bar is attached at a first end to a body of the motor vehicle and is attached to the door via a support housing, wherein the support housing abuts a compressible member, wherein the retarding force includes a reaction force produced by deformation of the compressible member, wherein the bar extends through an aperture in the compressible member, wherein the non-linear surface is a non-linear section of a groove of the bar, and further comprising a pin engaging the groove, wherein the groove includes a linear section parallel with a longitudinal axis of the bar and the non-linear section.

2. The motor vehicle as recited in claim 1, wherein the door check mechanism includes at least one detent configured to contact a recess in the bar to hold the door in the fully open check position.

3. The motor vehicle as recited in claim 2, wherein the detent is biased toward the recess by a spring.

4. The motor vehicle as recited in claim 1, wherein the pin is embedded in the compressible member.

5. The motor vehicle as recited in claim 1, wherein, when the pin engages the non-linear section, the compressible member is torsionally deformed.

6. The motor vehicle as recited in claim 1, wherein the non-linear portion diverges from the longitudinal axis of the bar.

7. The motor vehicle as recited in claim 1, wherein the non-linear portion is helical.

8. A motor vehicle, comprising:

a pivotable door;

a door check mechanism including a bar, wherein the door check mechanism is configured to hold the door open in a fully open check position; and a retarder assembly configured to oppose opening of the door beyond the fully open check position by applying a retarding force to the door, wherein the retarding force is generated by interaction between the retarder assembly and a non-linear surface of the bar, wherein the door check mechanism includes at least one detent configured to contact a recess in the bar to hold the door in the fully open check position, wherein the detent is biased toward the recess by a spring, wherein the bar is attached at a first end to a body of the motor vehicle and is attached to the door via a support housing, wherein the support housing is attached to a compressible member, wherein the retarding force includes a reaction force produced by deformation of the compressible member, wherein the bar extends through an aperture in the compressible member, wherein the non-linear surface of the bar is a curved portion of the bar or a non-linear portion of a groove of the bar, and wherein the compressible member is spaced-apart from the at least one detent in a direction toward the non-linear surface of the bar.

* * * * *